US007932476B2

(12) United States Patent
Kriegel et al.

(10) Patent No.: US 7,932,476 B2
(45) Date of Patent: Apr. 26, 2011

(54) TRANSMISSION FOR AN ELECTRICAL CIRCUIT BREAKER

(75) Inventors: Martin Kriegel, Unterehrendingen (CH); Olaf Hunger, Schaffhausen (CH)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 12/479,299

(22) Filed: Jun. 5, 2009

(65) Prior Publication Data

US 2009/0266795 A1 Oct. 29, 2009

Related U.S. Application Data

(63) Continuation of application No. PCT/EP2007/062479, filed on Nov. 19, 2007.

(30) Foreign Application Priority Data

Dec. 6, 2006 (EP) ..... 06405508

(51) Int. Cl.
*H01H 33/42* (2006.01)

(52) U.S. Cl. ..... 218/154; 218/78; 218/14

(58) Field of Classification Search ..... 218/2–7, 218/14, 78, 84, 120, 140, 152–154
See application file for complete search history.

(56) References Cited

U.S. PATENT DOCUMENTS

| | | | | |
|---|---|---|---|---|
| 5,293,014 | A * | 3/1994 | Perret | 218/57 |
| 5,478,980 | A | 12/1995 | Freeman et al. | |
| 5,578,806 | A | 11/1996 | Hofbauer et al. | |
| 5,905,242 | A * | 5/1999 | Bernard et al. | 218/16 |
| 6,177,643 | B1 * | 1/2001 | Marin et al. | 218/45 |
| 6,271,494 | B1 | 8/2001 | Dienemann et al. | |
| 6,410,873 | B1 * | 6/2002 | Chyla et al. | 218/78 |

FOREIGN PATENT DOCUMENTS

| | | | |
|---|---|---|---|
| DE | 197 30 583 | A1 | 2/1998 |
| DE | 100 03 359 | C1 | 7/2001 |
| EP | 0 696 040 | A1 | 2/1996 |
| EP | 0 809 269 | B1 | 11/1997 |
| EP | 0 822 565 | B1 | 2/1998 |
| EP | 0 992 050 | B1 | 4/2000 |
| EP | 1 211 706 | B1 | 6/2002 |

OTHER PUBLICATIONS

Form PCT/ISA/210 (International Search Report) dated Mar. 14, 2008.

Non-English version of Form PCT/ISA/237 (Written Opinion of the International Searching Authority) dated Mar. 14, 2008.

Non-English version of Form PCT/IPEA/409 (International Preliminary Report on Patentability) dated Mar. 19, 2009.

European Search Report (with English translation of Search Report categories) dated Mar. 23, 2007.

Notification of Transmittal of Translation of the International Preliminary Report on Patentability (Forms PCT/IB/338 and PCT/IPEA/409) issued in corresponding International Patent Application No. PCT/EP2007/062479 dated Jul. 9, 2009, The International Bureau of WIPO, Geneva, Switzerland.

* cited by examiner

*Primary Examiner* — Renee S Luebke
*Assistant Examiner* — Marina Fishman
(74) *Attorney, Agent, or Firm* — Buchanan Ingersoll & Rooney PC

(57) ABSTRACT

An electrical circuit breaker includes a first contact piece with a first consumable contact; a second contact piece with a second consumable contact; a drive for moving the first contact piece along a switching movement axis; and a transmission for transmitting the movement of the first contact piece to a movement of the second contact piece. The transmission has a first lever, a pivoting element which can pivot about a pivoting shaft, and a transmission mechanism for transmitting a pivoting movement of the pivoting element to a movement of the second contact piece.

22 Claims, 2 Drawing Sheets

TRANSMISSION FOR AN ELECTRICAL CIRCUIT BREAKER

RELATED APPLICATIONS

This application claims priority as a continuation application under 35 U.S.C. §120 to PCT/EP2007/062479, which was filed as an International Application on Nov. 19, 2007 designating the U.S., and which claims priority to European Application 06405508.0 filed in Europe on Dec. 6, 2006. The entire contents of these applications are hereby incorporated by reference in their entireties.

FIELD

The present disclosure relates to the field of electrical circuit breakers and to a method for opening the contacts of an electrical circuit breaker.

BACKGROUND INFORMATION

Known circuit breakers have two contact pieces, each having a consumable contact (tulip and pin), which can be disconnected as desired. Either only one contact piece or both contact pieces can be moved for disconnection. In another case, a drive can drive the tulip, and a transmission or auxiliary transmission transmits the movement of the tulip to the pin. For example, linear transmissions having a transmission ratio of 1:1 can be used, as disclosed in EP 0 822 565 or U.S. Pat. No. 5,478,980. The transmission ratio of the transmission is defined as the ratio of a movement speed or movement distance of the movement transmitted or produced by the transmission (output drive movement, such as a movement of the pin) to a movement speed or movement distance of a movement which drives the transmission (drive movement, such as a movement of the tulip).

Constant transmission ratios can also be provided which are greater than 1:1. In this case, at a given drive speed, the relative speed between the two contact pieces is increased, as a result of which the switch contacts can be disconnected more quickly. However, as the constant transmission ratio increases, the travel of the contact piece on the output drive side increases, and therefore the physical length of the quenching chamber increases, as well.

Transmissions with a transmission ratio which is not constant are likewise known. Transmissions such as these are disclosed, for example, in EP 0 992 050, EP 1 211 706 and DE 100 03 359.

EP 0 809 269 discloses an auxiliary transmission having a double-ended lever arm which is mounted in a fixed position such that it can rotate. At one end, the lever arm has an elongated hole for engagement for a driving tie rod which can be moved axially, and at the other end it has a fixed-articulated lever for transmitting force to the opposing contact.

EP 0 696 040 discloses an auxiliary transmission with a gearwheel which is mounted in a fixed position such that it can rotate. The gearwheel is driven by a toothed rod. A lever is articulated at a fixed predetermined position on the gearwheel surface in order to transmit force to the opposing contact.

However, transmissions with a transmission ratio that is not constant can occupy a large amount of physical space. The time profile of the transmission ratio of these transmissions is also often unsatisfactory.

The complete disclosures of all of the documents mentioned herein are incorporated by reference in their entireties.

SUMMARY

An electrical circuit breaker is disclosed, comprising: a first contact piece having a first contact; a second contact piece having a second contact; a drive for moving the first contact piece along a switch axis; and a transmission for transmitting movement of the first contact piece to a movement of the second contact piece, wherein the transmission includes a pivoting element for pivoting about a pivoting shaft, and a transmission mechanism for transmitting pivoting movement of the pivoting element to a movement of the second contact piece, and wherein the transmission includes a first lever for articulation by a rotating joint on the first contact piece, and by a thrust joint on the pivoting element, the thrust joint defining a fixed angle ratio between the first lever and the pivoting element.

A method for opening the contacts of an electrical circuit breaker is disclosed, which has a first contact piece with a first consumable contact, a second contact piece with a second consumable contact, a drive for moving the first contact piece along a switch axis and a transmission for moving the second contact piece, with the transmission comprising a first lever which is articulated by a rotating joint on the first contact piece, and a pivoting element which can pivot about a pivoting shaft, with the first lever being articulated by a thrust joint on the pivoting element, the method comprising: moving the first lever by movement of the first contact piece; pivoting the pivoting element by movement of the first lever about the pivoting shaft; and transmitting pivoting movement of the pivoting element by a transmission mechanism to a movement of the second contact piece.

BRIEF DESCRIPTION OF THE FIGURES

Exemplary embodiments of the disclosure will be described in more detail in the following text and are illustrated in the figures in which, for a circuit breaker.

DETAILED DESCRIPTION

According to one aspect of the disclosure, an electrical circuit breaker is disclosed which can, for example, include a first contact piece with a first contact, such as a consumable contact tulip; a second contact piece with a second contact, such as a consumable contact pin; a drive for moving the first contact piece along a switching movement axis or switch axis (e.g., parallel to it or parallel to it in the opposite direction), such as relative to a housing of the circuit breaker; and a transmission for transmitting the movement of the first contact piece to a movement of the second contact piece. The transmission can include: a first lever, a pivoting element which can pivot about a pivoting shaft, and a transmission mechanism for transmitting a pivoting movement of the pivoting element to a movement of the second contact piece. The first lever can be articulated by the rotating joint on the first contact piece, and/or by means of a thrust joint on the pivoting element. The thrust joint defines a fixed angle ratio between the first lever and the pivoting element, so that a rotary movement of the first lever pivots the pivoting element while, in contrast, a linear or translational movement of the first lever does not pivot the pivoting element. The rotating joints can be pure rotating joints, that is to say they do not allow any relative linear movement between the articulated parts. The thrust joint can define a thrust axis which intersects the pivoting shaft.

According to a further aspect of the disclosure, a method is proposed for opening the contacts of an electrical circuit breaker. The circuit breaker can, for example, include a first contact piece with a first consumable contact, a second contact piece with a second consumable contact, a drive for moving the first contact piece along a switch axis and a transmission for moving the second contact piece, with the transmission having a first lever, which is articulated by means of a rotating joint on the first contact piece, and a pivoting element which can pivot about a pivoting shaft. The method can include the following steps: the first lever is moved by the movement of the first contact piece, with the movement of the first lever, for example, being a rotary movement for example about the pivoting shaft and with a linear movement superimposed on it; the pivoting element can be pivoted by the movement, for example, by the rotary movement of the first lever about the pivoting shaft. The pivoting movement of the pivoting element can be transmitted by a transmission mechanism to a movement of the second contact piece, for example, to a longitudinal movement along the switching movement axis or switch axis. The first lever can be articulated by a rotating joint on the first contact piece and/or can be articulated by a thrust joint on the pivoting element.

Figure 1:
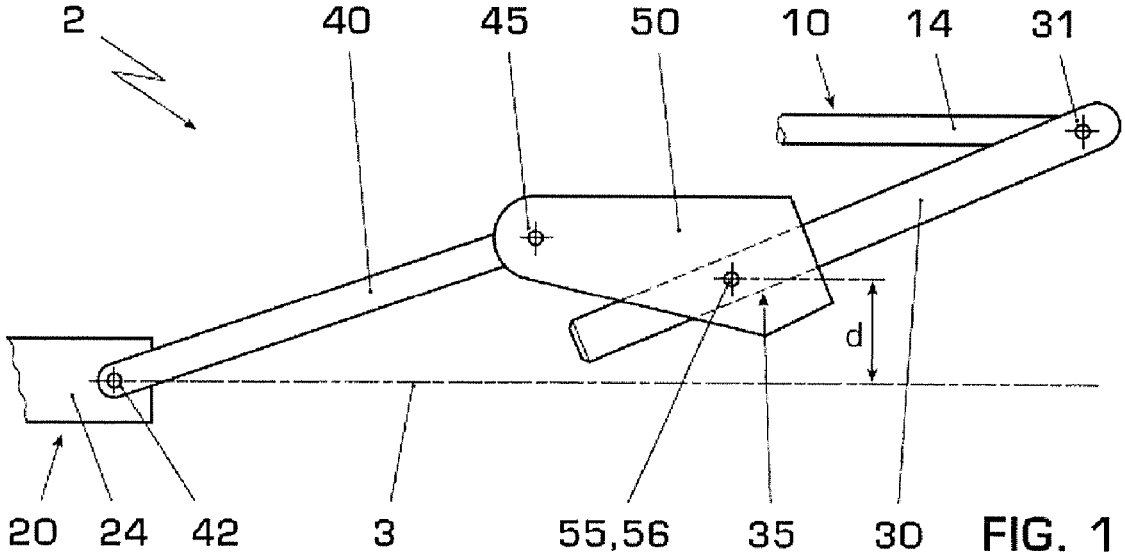
FIG. 1 shows a first exemplary embodiment of an auxiliary transmission according to the disclosure.

FIG. 1 shows a first exemplary embodiment of a circuit breaker according to the disclosure. The circuit breaker includes a first contact piece 10 with a first consumable contact (not illustrated), which can be in the form of a tulip, and a second contact piece 20 with a second consumable contact (not illustrated), which can be in the form of a pin. The consumable contacts and further elements, which are not illustrated, of the circuit breaker, for example quenching apparatuses for an arc by means of an inert gas, are designed in known manner. Sliding elements, ties rods or thrust rods 14, 24 of the first and second contact pieces 10, 20 are illustrated, and are connected in a suitable manner to the consumable contacts, or in general to the contacts of the switch to be switched. The contact pieces 10, 20 can move along a switch axis or switching movement axis 3, that is to say parallel to it or parallel to it in the opposite direction, in that they are mounted, for example, on rails or in sliding bearings.

The circuit breaker furthermore includes an auxiliary transmission or transmission 2. The transmission 2 has a first lever 30, a pivoting element 50, and a second lever 40. The first lever 30 is articulated by, for example, means of a rotating joint 31 on the first contact piece 10, and is articulated by, for example, means of a thrust joint 35 or a rotating thrust joint 35 on the pivoting element 50. The pivoting element 50 can be mounted by means of a rotating joint 55 such that it can pivot about a pivoting shaft 56. The rotating joint 55 can be fitted to a stationary part of the circuit breaker, for example to its housing. The pivoting shaft 56 is then in a fixed position, for example relative to the housing of the circuit breaker. Furthermore, the pivoting shaft 56 can be aligned at right angles to the switch axis 3.

The pivoting shaft 56 can be arranged laterally offset at a distance d from the switch axis 3. For example, the pivoting shaft 56 can be arranged in a laterally offset position between the switch axis 3 and the first contact piece 10, that is to say offset upward as illustrated in FIG. 1.

The thrust joint 35 defines a fixed angle ratio between the lever 30, that is to say between an axis which is defined by the lever 30 or its longitudinal extent, and the pivoting element 50. The pivoting element 50 can therefore be driven with a constant relative angle by a rotary movement of the lever 30, and can thus be pivoted. A linear movement of the lever 30 along a thrust axis of the thrust joint 35 in contrast does not pivot the pivoting element 50.

Figure 2:
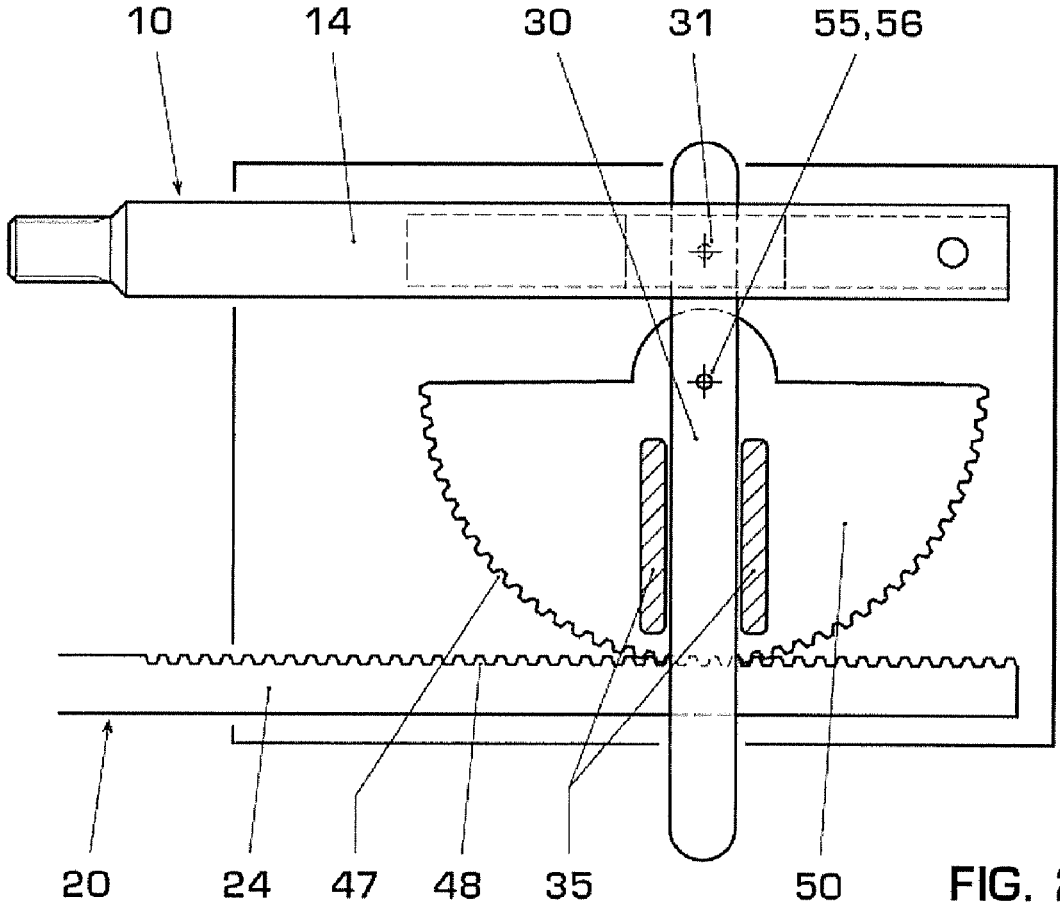
FIG. 2 shows a second exemplary embodiment of an auxiliary transmission according to the disclosure.

The first lever 30 can have an end which is cylindrical or in the form of a ram, which is mounted such that it can slide in the thrust joint 35. As is illustrated in FIG. 1 or 2, the entire first lever 30 may also be cylindrical, and, for example, may have a round cross section. The first lever 30 can also have a different cross section, for example rectangular cross section, for example on the length of the first lever 30 which slides in the thrust joint 35 during a switching process. The thrust joint 35 then has a hole and in particular a sliding surface or cylindrical guide of appropriate shape, thus resulting in a good interlocking contact for transmission of the rotary movement of the first lever 30 to the pivoting element 50. In any case, the thrust joint 35 can define a thrust axis for the first lever 30, that is to say a sliding direction of the first lever 30 in the thrust joint 35. The thrust joint 35 can be arranged such that the thrust axis is at right angles to the pivoting shaft 56, and/or such that the thrust axis intersects the pivoting shaft 56; however, this is not absolutely needed. The thrust axis can be at right angles to the pivoting shaft 56.

The second lever 40 can be articulated by means of a rotating joint 45 on the pivoting element 50 such that it can rotate eccentrically with respect to the pivoting shaft 56, and can be articulated by means of a further rotating joint 42 on the second contact piece 20 such that it can rotate. The second lever 40 therefore forms a transmission mechanism 40 for transmitting a pivoting movement of the pivoting element 50 about the pivoting shaft 56 to a longitudinal movement of the second contact piece 20.

FIG. 1 shows an exemplary embodiment of a circuit breaker in a closed state, in which the consumable contacts of the two contact pieces 10, 20 make electrical contact with one another. In order to disconnect the electrical contact, the first contact piece 10 can be moved to the left along the switch axis 3 by means of a drive (not illustrated). The transmission 2 can transmit this movement of the first contact piece 10 to a movement in the opposite direction, with a non-linear transmission characteristic, for the second contact piece 20 to the right. For this purpose, the lever 30 is first of all moved into the thrust joint 35 by the movement of the first contact piece 10 to the left, thus shortening the distance between the rotating joint 31 and the thrust joint 35. At the same time, the lever 30 is rotated in the counterclockwise direction. Since the thrust joint 35 defines a fixed angle ratio between the lever 30 and the pivoting element 50, the pivoting element 50 is likewise also rotated or pivoted in the counterclockwise direction, to be precise about the pivoting shaft 56. The pivoting movement of the pivoting element 50 is then transmitted by the lever 40 to a longitudinal movement of the second contact piece 20 along the switch axis 3 to the right. The movement of the second contact piece 20 is therefore in the opposite direction to the movement of the first contact piece 10, that is to say it is directed to the right, thus increasing the relative speed between the contact pieces 10 and 20 as a result of the additional movement which is transmitted by the transmission 2 to the second contact piece 20.

The lever 30 carries out both a linear or translational movement and a rotary movement relative to the pivoting shaft 56. At the start of the movement, that is to say when the transmission 2 is in the state illustrated in FIG. 1, the lever 30 is pushed into the thrust joint 35, and rotates only by a relatively small amount. When the first contact piece is moved further to the left, then the rotary movement of the lever 30 gradually increases with respect to the longitudinal movement of the first contact piece 10 while, in contrast, the linear movement of the lever 30 decreases, until the rotating joint 31 is located vertically above the thrust joint 55. At this time, the lever 30 carries out only a rotary movement, and no linear movement. When the first contact piece 10 is moved even further to the left, then the lever 30 is put out of the thrust joint 35 again, and the rotary movement of the lever 30 gradually decreases again. Since only the rotary movement and not the linear or pulling movement of the lever 30 is transmitted to the pivoting element 50, this therefore allows the transmission 2 to have a variable transmission ratio.

For example, this makes it possible for the transmission ratio to depend on the current position of the first contact piece 10, that is to say on its displacement along the switch axis 3.

Figure 3:
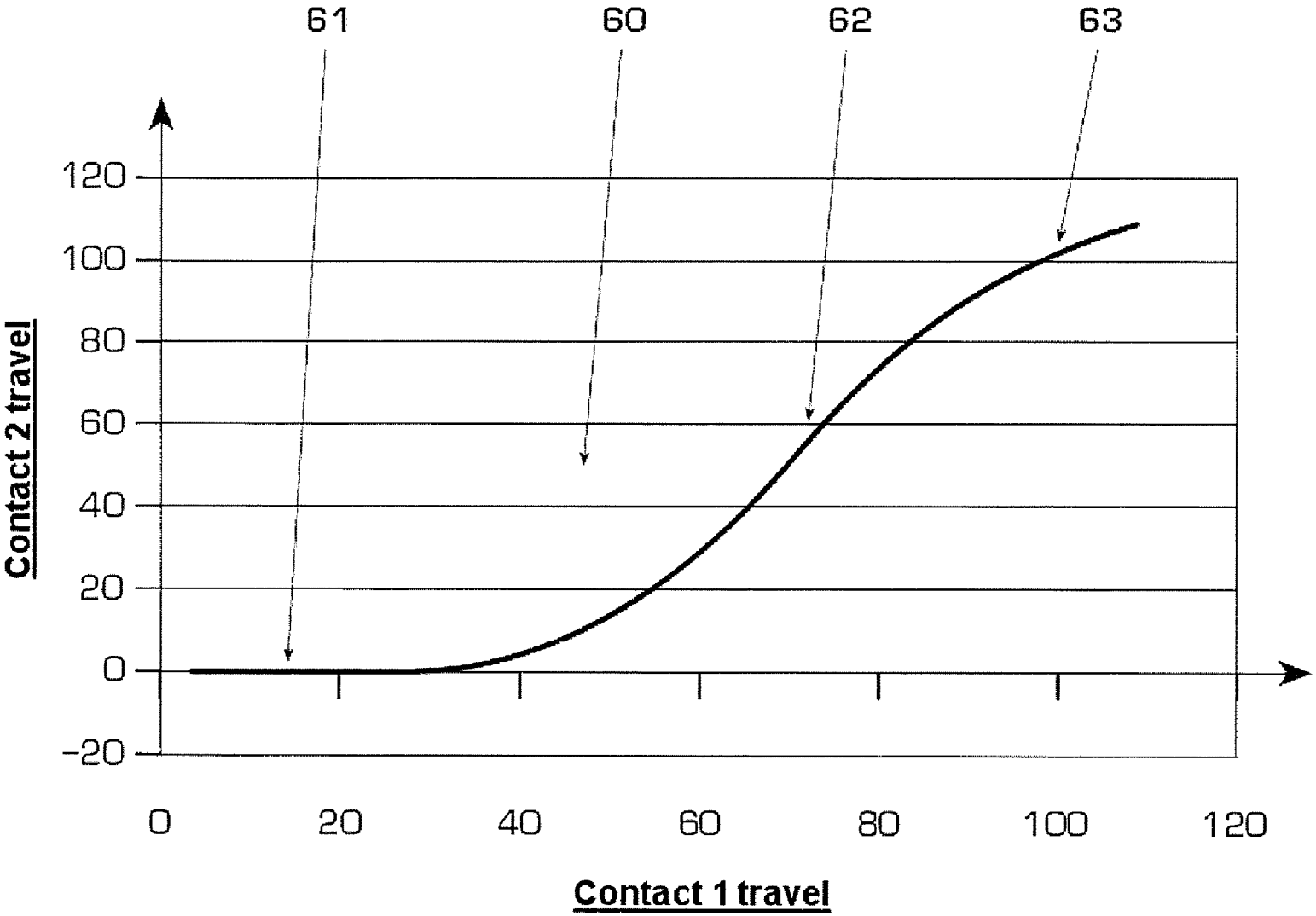
FIG. 3 shows a diagram illustrating travel of a second contact piece as a function of travel of a first contact piece.

FIG. 3 shows a travel/travel diagram, in which the travel is equal to the movement distance traveled by the contact pieces 10, 20, and the associated contacts. The diagram shows the travel curve 60, that is to say the travel of the second contact piece 20, in mm (contact 2, vertical axis), as a function of the travel of the first contact piece 10, in mm (contact 1, horizontal axis). The transmission ratio of the transmission 2 is given by the derivative of the travel curve 60.

The travel curve 60 shows that the transmission ratio is variable, and therefore not constant, during a switching process of the circuit breaker, that is to say it varies as a function of the position of the contact pieces 10, 20 and the rotation position of the pivoting element 50. In a first phase 61, the travel of the second contact piece 20 scarcely changes, that is to say the transmission ratio of the transmission 2 is approximately zero or is small. This phase 61 corresponds to the state as illustrated in FIG. 1, in which the lever 30 is mainly pushed into the thrust joint 35 and is rotated only by a relatively small amount. In a subsequent second phase 62, the transmission ratio of the transmission 2, that is to say the gradient of the travel curve 60, is high and in particular passes through a maximum when the rotating joint 31 is positioned vertically above the thrust joint 55. This phase 62 corresponds to the state in which a rotary movement takes place virtually exclusively, with scarcely any linear movement of the lever 30. The transmission ratio of the transmission 2 decreases again in a subsequent third phase 63.

The time at which the physical contact between the first and the second consumable contact is disconnected and at which an arc is struck can occur only after the first phase 61, and therefore in the second phase 62. At this time, the transmission 2 has a considerably higher transmission ratio than at the start of the movement, that is to say with the circuit breaker completely closed. For example, in comparison to the start of the movement, the transmission ratio of the transmission 2 on disconnection of the contact is greater by a factor which is greater than 2:1 or even greater than 5:1. This makes it possible to provide a high relative speed between the contact pieces 10 and 20 at this time. However, in order to avoid excessive wear of the contact pieces it can be desirable for a maximum transmission ratio not to be reached until the contacts have been disconnected. In an exemplary embodiment, it can be advantageous for the maximum transmission ratio to be greater than 1:1, preferably greater than 1.5:1 and particularly preferably greater than 2:1.

The time period between the physical disconnection or contact disconnection of the consumable contacts and the enabling of a dielectric nozzle for quenching the arc can be chosen such that it comprises the second phase 62 or in any case a part of the travel curve with a high transmission ratio. It can therefore be advantageous in an exemplary embodiment to choose the transmission ratio of the transmission 2 in the second phase 62 and/or between contact disconnection of the consumable contacts and the enabling of the dielectric nozzle for quenching of the arc to always be above the value 1:1, preferably above the value 1.5:1, and particularly preferably above the value 2:1. This makes it possible to achieve a high relative speed between the contact pieces 10 and 20 throughout this entire time period.

Since the transmission ratio of the transmission 2 is limited in time periods other than those mentioned above, the overall travel of the contact pieces 10 and 20 can nevertheless be kept short. The rapid pin movement, for example a transmission ratio of greater than 2:1 or 1.5:1 or 1:1, can therefore be limited to the time period between contact disconnection and the moment at which the nozzle is enabled, and the circuit breaker can be designed to be compact at the same time. The initially low transmission ratio furthermore makes it possible to separate the time period in which the first contact piece 10 is accelerated by the drive from the time period in which the second contact piece 20 is accelerated by the drive via the transmission 2. The drive load can therefore be distributed over a longer time period, and load peaks for the drive can be reduced. The drive can therefore be designed to be weaker, or a higher acceleration of the contacts or consumable contacts can be achieved.

FIG. 2 shows a second exemplary embodiment of a circuit breaker according to the disclosure. Identical or similar parts to those in FIG. 1 are provided with the same reference symbols in this figure. In contrast to the transmission in FIG. 1, the transmission 2 in FIG. 2 does not have a second lever 40. Instead of this, the transmission mechanism for transmission of a pivoting movement of the pivoting element 50 to a movement of the second contact piece 20 is formed by a gearwheel 47 and a toothed rod 48. The gearwheel 47 is attached to the pivoting element 50, such that it is mounted together with the pivoting element 50 such that it can pivot or rotate about the pivoting shaft 56. It has a rotation axis which is coincident with the pivoting shaft 56. The toothed rod 48 can be moved with the second contact piece 20, and is attached to it. The gearwheel 47 engages with the toothed rod 48, and drives this as required.

FIG. 2 illustrates that the transmission of the circuit breaker according to the disclosure can be equipped with any desired known transmission mechanism 40; 47, 48 for transmission of a pivoting movement of the pivoting element 50 to a movement of the second contact piece 20.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

2 Transmission
3 Center axis, switch axis, switching movement axis
10 First contact piece, contact 1
14 First sliding element, first tie rod
20 Second contact piece, contact 2
24 Second sliding element, second tie rod
30 First lever, first rod
31 Rotating joint 30-10
35 Rotating-thrust joint 30-50
40 Second lever, second rod

42 Rotating joint 40-20
45 Rotating joint 40-50
47 Gearwheel
48 Toothed rod
50 Pivoting element
55 Stationary rotating joint
56 Pivoting shaft
60 Travel curve
61 First phase
62 Second phase
63 Third phase
d Distance, lateral offset

What is claimed is:

1. An electrical circuit breaker, comprising:

a first contact piece having a first contact;

a second contact piece having a second contact;

a drive for moving the first contact piece along a switch axis; and a transmission for transmitting movement of the first contact piece to a movement of the second contact piece, wherein the transmission includes a pivoting element for pivoting about a pivoting shaft, and a transmission mechanism for transmitting pivoting movement of the pivoting element to a movement of the second contact piece, and wherein the transmission includes a first lever for articulation by a rotating joint on the first contact piece, and by a slider joint on the pivoting element, the slider joint defining a fixed angle between the first lever and the pivoting element.

2. The electrical circuit breaker as claimed in claim 1, wherein a transmission ratio of the transmission during a switching process varies as a function of a position of the first and second contact pieces.

3. The electrical circuit breaker as claimed in claim 2, wherein the transmission ratio of the transmission during a switching process is approximately zero in a first phase, passes through a maximum in a subsequent second phase, and decreases again in a subsequent third phase.

4. The electrical circuit breaker as claimed in claims 3, wherein movement of the first contact piece results in disconnection of first and second consumable contacts, and the transmission ratio of the transmission on contact disconnection of the first and second consumable contacts is greater than at a start of the first contact piece movement.

5. The electrical circuit breaker as claimed in claim 4, wherein at least one of a time of contact disconnection of the first and second consumable contacts occurs in the second phase; and a maximum transmission ratio is achieved only when the first and second consumable contacts have been disconnected, the maximum transmission ratio being greater than 1:1.

6. The electrical circuit breaker as claimed in claim 4, wherein at least one of:

the transmission ratio in the second phase or between contact disconnection of the consumable contacts or the transmission ratio in the second phase and or between contact disconnection of the consumable contacts, and the enabling of a dielectric nozzle for quenching the arc is to be above a value of 1:1; and a transmission ratio of greater than the value is limited to a time period between contact disconnection of the consumable contacts and a moment at which the nozzle is enabled.

7. The electrical circuit breaker as claimed in claim 1, wherein at least one of the pivoting shaft of the pivoting element is mounted in a fixed position;

the pivoting shaft is aligned at right angles to the switch axis; and the pivoting shaft is arranged laterally offset at a distance from the switch axis, in a laterally offset position between the switch axis and the first contact piece.

8. The electrical circuit breaker as claimed in claim 1, wherein at least one of the first lever has a cylindrical end which is mounted such that it slides in the slider joint; and a thrust axis of the thrust joint is at right angles to the pivoting shaft and/or intersects the pivoting shaft.

9. The electrical circuit breaker as claimed in claim 1, wherein the transmission mechanism is configured to transmit the pivoting movement of the pivoting element about the pivoting shaft to a longitudinal movement of the second contact piece along the switch axis.

10. The electrical circuit breaker as claimed in claim 1, wherein the transmission mechanism comprises:

a second lever which is articulated to rotate by a rotating joint, on the pivoting element, and to rotate by a further rotating joint, on the second contact piece.

11. The electrical circuit breaker as claimed in claim 1, wherein the transmission mechanism comprises:

a gearwheel and a toothed rod which can move with the second contact piece and engages with the gearwheel.

12. The electrical circuit breaker as claimed in claim 11, wherein the gearwheel comprises:

a rotation axis which is located on the pivoting shaft to pivot together with the pivoting element about the pivoting shaft.

13. The electrical circuit breaker as claimed in claim 2, wherein movement of the first contact piece results in disconnection of first and second consumable contacts, and the transmission ratio of the transmission on contact disconnection of the first and second consumable contacts is greater than 5:1.

14. The electrical circuit breaker as claimed in claim 4, wherein at least one of a time of contact disconnection of the first and second consumable contacts occurs in the second phase; and a maximum transmission ratio is achieved when the first and second consumable contacts have been disconnected, the maximum transmission ratio being greater than 1.5:1.

15. The electrical circuit breaker as claimed in claim 4, wherein at least one of a time of contact disconnection of the first and second consumable contacts occurs in the second phase; and a maximum transmission ratio is achieved when the first and second consumable contacts have been disconnected, the maximum transmission ratio being greater than 2:1.

16. The electrical circuit breaker as claimed in claim 4, wherein at least one of:

the transmission ratio in the second phase or between contact disconnection of the consumable contacts or the transmission ratio in the second phase and or between contact disconnection of the consumable contacts, and the enabling of a dielectric nozzle for quenching the arc is to be above a value of 1.5:1; and a transmission ratio of greater than the value is limited to a time period between contact disconnection of the consumable contacts and a moment at which the nozzle is enabled.

17. The electrical circuit breaker as claimed in claim 4, wherein at least one of:

the transmission ratio in the second phase or between contact disconnection of the consumable contacts or the transmission ratio in the second phase and or between contact disconnection of the consumable contacts, and the enabling of a dielectric nozzle for quenching the arc is to be above a value of 2:1; and a transmission ratio of greater than the value is limited to a time period between contact disconnection of the consumable contacts and a moment at which the nozzle is enabled.

18. The electrical circuit breaker as claimed in claim 6, wherein at least one of the pivoting shaft of the pivoting element is mounted in a fixed position;

the pivoting shaft is aligned at right angles to the switch axis; and the pivoting shaft is arranged laterally offset at a distance from the switch axis, in a laterally offset position between the switch axis and the first contact piece.

19. A method for opening the contacts of an electrical circuit breaker, which has a first contact piece with a first consumable contact, a second contact piece with a second consumable contact, a drive for moving the first contact piece along a switch axis and a transmission for moving the second contact piece, with the transmission comprising a first lever which is articulated by a rotating joint on the first contact piece, and a pivoting element which can pivot about a pivoting shaft, with the first lever being articulated by a slider joint on the pivoting element, the method comprising:

moving the first lever by movement of the first contact piece;

pivoting the pivoting element by movement of the first lever about the pivoting shaft; and transmitting pivoting movement of the pivoting element by a transmission mechanism to a movement of the second contact piece.

20. The method as claimed in claim 19, wherein the movement of the first lever is a rotary movement about the pivoting shaft, with a linear movement superimposed thereon.

21. The method as claimed in claim 19, comprising:

defining a fixed angle between the first lever and the pivoting angle with the slider joint, such that a rotary movement of the first lever pivots the pivoting element while, in contrast, a translational movement of the first lever does not pivot the pivoting element.

22. The method as claimed in claim 19, comprising at least one of:

mounting the pivoting shaft of the pivoting element in a fixed position;

aligning the pivoting shaft at right angles to the switch axis; and arranging the pivoting shaft laterally offset at a distance from the switch axis, in a laterally offset position between the switch axis and the first contact piece.

* * * * *